United States Patent [19]

Rogers

[11] 4,042,987

[45] Aug. 23, 1977

[54] RESILIENT SUPPORT

[75] Inventor: John E. Rogers, Anaheim, Calif.

[73] Assignee: Ronald J. P. Evans, Bushey Heath, England

[21] Appl. No.: 677,552

[22] Filed: Apr. 16, 1976

[51] Int. Cl.[2] ..... A47C 27/08

[52] U.S. Cl. ..... 5/345 R; 5/91; 5/361 B

[58] Field of Search ..... 5/91, 345 R, 351, 355, 5/361 R

[56] References Cited

U.S. PATENT DOCUMENTS

| | | | |
|---|---|---|---|
| 3,135,974 | 6/1964 | Roman | 5/91 |
| 3,222,697 | 12/1965 | Scheermesser | 5/361 B |
| 3,512,190 | 5/1970 | Buff | 5/345 R |
| 3,731,327 | 5/1973 | Frey | 5/345 R |
| 3,828,378 | 8/1974 | Flam | 5/345 R |
| 3,885,257 | 5/1975 | Rogers et al. | 5/345 R |
| 3,893,198 | 7/1975 | Blair | 5/345 R |

*Prin.ary Examiner*—Casmir A. Nunberg
*Attorney, Agent, or Firm*—William C. Babcock

[57] ABSTRACT

Method and apparatus for achieving various degrees of stress transfer within a resilient support pad comprising slots arranged longitudinally in the pad surface disposed to support the upper torso of a person and a rectangular matrix of slots in the support area below the lower torso. To provide for various levels of stress transfer control the pad itself may comprise two contiguous layers, each slotted to a desired depth. Further variants of the slot structure provide for narrow connecting webs thereacross for allowing controlled stress transfer thereacross.

7 Claims, 6 Drawing Figures

RESILIENT SUPPORT

BACKGROUND OF THE INVENTION

1. Field of the Invention

The present invention relates to resilient support pads and, more particularly, to support pads made from a resilient material like foam rubber, including slots in the supporting surface thereof adapted for controlling surface strain thereof.

2. Description of the Prior Art

The use of slits or partitions to control the tensile characteristics of a foam rubber support pad have been known in the past. Most often such use is made when the phenomenon, often referred to as "the hammock phenomenon," is to be avoided.

Generally, the hammock phenomenon occurs as a result of the tensile stresses along the support surface of the pad which transforms the compressive load into a distributed tensile surface strain through shear transfers within the material of the pad. This hammock effect provides the often recognized undesirable result of reducing the support levels around a localized area of higher loading. Thus, two people lying on the same pad will often be directed towards each other with the uncomfortable associated result. To alleviate this problem in the past, slits, partly extending through the supporting surface of the pad, were formed, such slits providing a break in the tensile stress distribution to thereby localize any high pressure points. One example of such slitting is that shown in U.S. Pat. No. 3,512,190. Further improvements to this manner of spring control are shown in my prior U.S. Pat. No. 3,885,257. Both of the above-described techniques, and in particular the techniques described in my prior patent, are useful in controlling the strain propagation along the surface of the cushion or pad. My prior technique, in addition to control over strain propagation, also provides control over the compressive spring characteristics of the pads. The above-described techniques, while generally useful, have heretofore never been applied to the load distribution and strain distribution desired in a supporting surface of a mattress. In a mattress the support area immediately subjacent the upper torso of the supported person is most often exercised in transverse or lateral surface strain. Furthermore, this body area is relatively-large and the resulting pressure thereof is therefore distributed over a substantially large surface. The lower torso, however, including the hip area of the person, both entails more localized pressure spots and additionally involves movements which are both longitudinal with the mattress and transverse or lateral across the mattress. This uneven loading of a mattress is often critical in medical applications where various incidents of trauma dictate various levels of control over the restraint and support levels achieved by the mattress.

SUMMARY OF THE INVENTION

Accordingly, it is the general purpose and object of the present invention to provide means for adapting the strain transfer characteristics of a resilient support pad to varying needs of a human torso.

Other objects of the invention are to provide a support pad or mattress formed of a resilient structure like foam rubber which includes, on the supporting surface thereof, convolutions adapted to control the localized compressive spring constants thereof.

Yet further objects of the invention are to provide means for controlling the stress characteristics of a resilient support pad which is easy to achieve, simple to maintain and therefore convenient in use.

Briefly these and other objects are accomplished within the present invention by forming a support pad or mattress in a conventional rectangular plan form, said pad or mattress comprising two contiguous layers of resilient material such as foam rubber or other synthetic foam (e.g. polyurethane foam) where either one or both of the layers are longitudinally slotted over the area subjacent the upper torso of a person resting thereon. The support area below the lower torso is similarly slotted, however, in a matrix slot arrangement whereby a plurality of rectangular segments are formed in the surface subjacent the hip and the lower torso of the person. Both the longitudinal slots and the slot matrix are disposed centrally within the support surface of the pad to thus provide an integral border thereabout which will therefore possess higher spring constants to maintain the shape of the mattress. To provide varying degrees of control over the transfer of the shear stresses through the structure of the pad, both the upper and lower sections thereof may be provided with thin webbings across each slot, the upper and the lower sections being further joined across such thin webbing. With this structural arrangement, various levels of local resiliency can be achieved with further control over the shear and tensile stress transfers through the pad structure. In this manner the various contours of the body and various degrees of control over mobility can be achieved with minimal investment in tooling and with minimal degradation of the total integrity of the pad.

DESCRIPTION OF THE SPECIFIC EMBODIMENT

Figure 1:
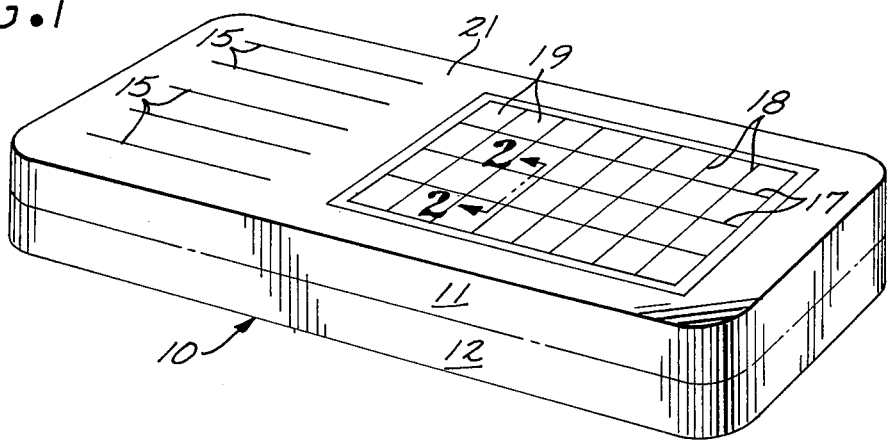
FIG. 1 is a perspective view of a resilient pad constructed according to the present invention.

As shown in FIG. 1 a support pad, generally designated by the numeral 10, comprises upper and lower sections respectively 11 and 12, both cut to a common planform conformed to the shape of a mattress. Formed on the upper exterior surface of section 11 and arranged along longitudinal planes therethrough are a plurality of longitudinal slits 15 extending vertically into the section 11. Slits 15 are disposed in the surface of section 11 to extend over a surface section of pad 10 intended to support the upper torso of a person. Formed longitudinally adjacent to the section including slit 15 is an array of rectangularly aligned slits 17 and 18 which again partly extend into the interior of the pad 10 to form, on the surface thereof, a plurality of adjacent rectangular support segments 19. By virture of this slit arrangement through the structure of pad 10 the shear stresses involved in transforming compressive loads into surface strain are fragmented with the attendant fragmentation of strain or surface deformation. By way of the following embodiments disclosed various levels of stress transfer are provided both to accommodate the spring characteristics of the pad and to achieve various levels of surface strain.

Figure 2:
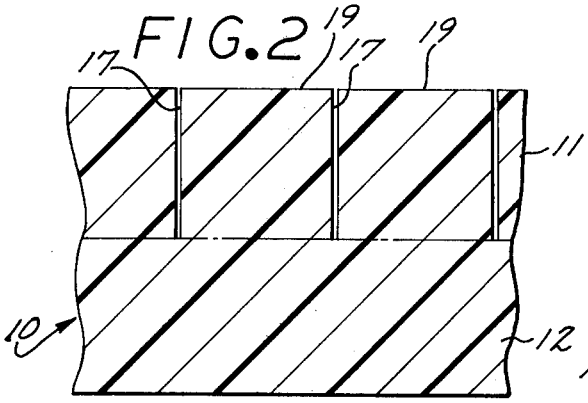
FIG. 2 is a sectional view taken along the line 2—2 of FIG. 1.

By specific reference to FIG. 2, one embodiment illustrating the function of the slits disclosed herein, provides such slits extending through the full thickness of section 11. In this context it is contemplated that sections 11 and 12 may be alternatively either part of a single integral structure or two separate layers of resilient material joined at the common surface thereof. As those skilled in the art will observe, the surface shear stresses along slits 17 are therefore substantially negligible or zero. Thus, any compressive deformation of a pad 19 will result in only a small surface deformation since no stress transfer can take place across the slits. To accommodate various needs, sections 11 and 12 may be formed from a resilient material such as foam rubber or foam polyurethane, either open-celled or close-celled, with various foam size and resiliency characteristics in the two sections. This arrangement of materials and configuration of slits provide for convenient control over the surface characteristics and local resiliency of the pad 10. As will be observed by reference back to FIG. 1, the disposition of slits 15, 17 and 18 is substantially central to the surrounding surface of pad 10. Accordingly, an integral peripheral strip 21 is formed to maintain the desired shape of the mattress and to furthermore localize the person in a central position on the pad.

Figure 3:
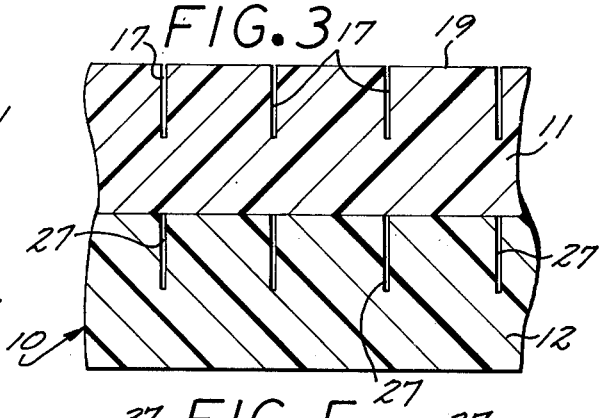
FIG. 3 is an alternative sectional view illustrating a further embodiment of the structure shown in FIG. 2.

An alternative arrangement for achieving control over the stress transfer within the pad 10 and therefore the surface characteristics thereof is shown in FIG. 3. In this figure, slot 17 for example, extends only partly through the thickness of section 11. Thus, section 11 includes an integral structure below these slots through which both shear and tensile stress transfer can take place. By controlling the depth of slot 17 and the shear and tensile characteristics of section 11, the degree of shear transfer and the consequent surface strain of segments 19, can be controlled. To isolate the structural effects of section 12 from section 11 there are formed thereon yet another set of slits 27 which, in this instance, may be either coincident with slits 17 or, if desired, may be off-set therefrom. Again slits 27 are formed to only partly extend into the interior of section 12 thus similarly allowing for partial tensile and shear transfer thereacross. This arrangement of slits 27 in subjacent proximity with the integral part of section 11 effectively decouples the transfer of shear force across the common surface thereof, thus decoupling and controlling the amount of the compound surface resiliency of the pad.

Figure 4:
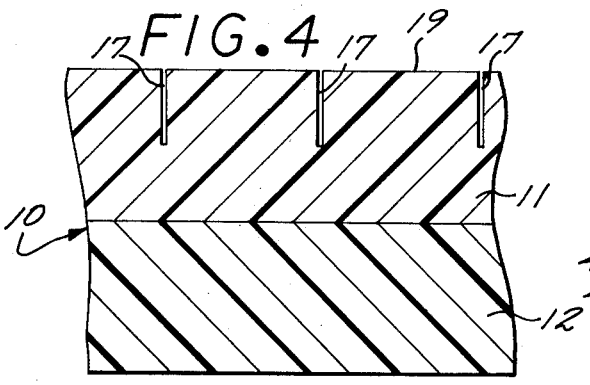
FIG. 4 is yet another alternative embodiment of the sectional structure of FIG. 2.

Yet another arrangement of slits is shown in FIG. 4. In this instance, section 12 is shown as a wholly integral section having no shear relieving slits formed therein. Section 11, similar to the arrangement shown in FIG. 3, includes slits 17 projecting only partly through the thickness thereof. Thus large amounts of tensile and shear transfer will occur below the surface of the pad, which by virtue of the hammock effect stated above, will assist to locate the person within a particular arrangement on the pad.

By way of the latter three illustrations, various amounts of lateral transfer of compressive forces is accommodated. Furthermore, while reference is consistently made to slits 17, such is for purposes of illustration only. It is to be understood that slits 18 and 15 can be similarly arranged or, in fact, can be selectively conformed to any one of the various alternatives.

Figure 5:
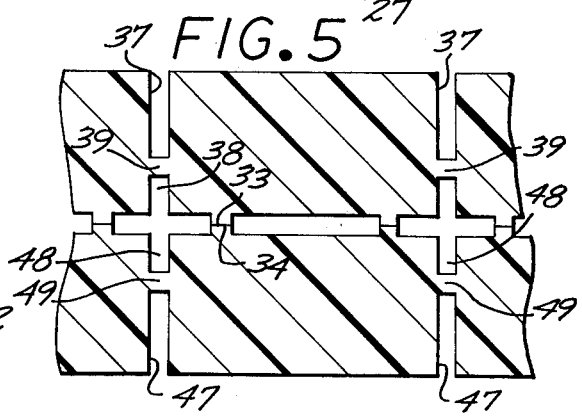
FIG. 5 is a yet further sectional arrangement illustrating an embodiment of the structure shown in FIG. 1 whereby extended control over the local pad resiliency can be achieved.

In each of the foregoing sectional embodiments a contiguous interface between the surface of section 12 and surface of section 11 is contemplated. Either by local friction or by bonding itself, this contiguous arrangement will result in shear stress transfers across this interface. Thus, should the effects of this shear transfer be not desired yet further arrangement of the sectional form of sections 11 and 12 is shown in FIG. 5. By way of this arrangement, slits 17 (and also 15 and 18, by common example,) are formed as grooves 37 which partly extend, once again, into the interior of section 11. Similarly section 12, on the opposing exterior surface, includes grooves 47. Extending in opposition into the interior of sections 11 and 12 are yet additional grooves 38 and 48 respectively, whereby only small sections 39 separate the opposed grooves 38 and 37 for example, to transfer tensile and shear stresses between the adjacent segments. Similarly, a web 49 joins the segment bounded by grooves 48 and 47 in section 12. The interface between sections 11 and 12 furthermore include a plurality of opposed ridges 33 and 43 across which the bond is made. Thus only thin webs join both the sections 11 and 12 and the segments thereof. These thin webs effect a low modulous of shear and tensile transfer, thus isolating the stresses of one segment from the other segment.

It is intended that such grooves and ridges be formed by way of adapting the tool shown in FIG. 1 in my prior U.S. Pat. No. 3,885,257. With this tool, various dimensions of grooves 37, 38, 47 and 48 can be achieved with the resulting control over the strain coupling between the segments.

Figure 6:
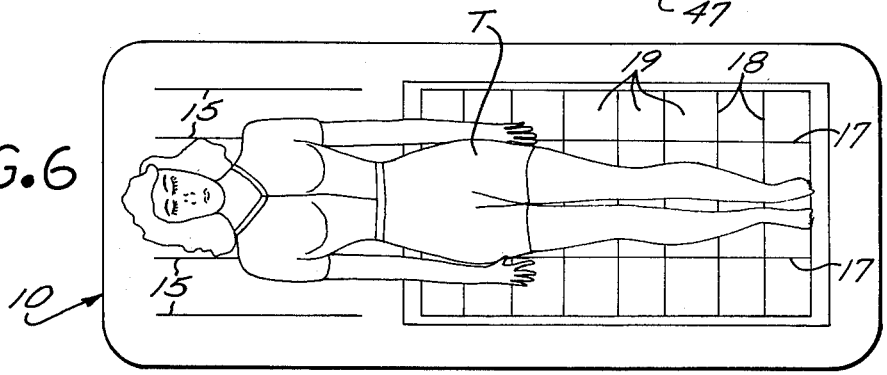
FIG. 6 is a plan view of the inventive support pad illustrating the arrangement thereof relative the torso of a person.

As illustrated in FIG. 6, this arrangement of slits or grooves can be selected to underlie various portions of a human torso. As previously disclosed the lower part of the torso is supported by the rectangular segments 19 and is therefore restrained laterally at a lower level than the restraint of the upper torso by the longitudinal slits 15. Since the upper part of the torso generally includes a relatively large, longitudinal section of the back, the associated deformation of the surface subjacent thereto does not require the accommodating functions of segments 19.

Thus, by way of this arrangement of parts and selection of geometry, full adaptation to a human torso can be conveniently made. This adaptation can be carried even further by way of the selection of embodiments disclosed herein to accommodate persons of various sizes and to further accommodate clinical situations which are unique with the particular use of the pad.

Obviously many modifications and variations to the above disclosure can be made without departing from the spirit of the invention. It is therefore intended that the scope of the invention be determined solely dependent on the claims hereto.

I claim:

1. In a resilient support pad adapted to support a human torso in a prone or reclining state the improvements comprising:

a plurality of first slits longitudinally formed in the surface of said pad subjacent the upper section of said torso;

a plurality of second slits formed in the surface of said pad subjacent the lower section of said torso, selected ones of said second slits being aligned to intersect selected other ones thereof; and said first and second slits terminating within a predetermined distance of the periphery of said pad each extending into the interior of said pad to a predetermined depth for interrupting the transfer of stresses within said pad at the surfaces thereof.

2. Apparatus according to claim 1 wherein:

said pad includes a first and second resilient layer conformed to a common planform said first layer being disposed to overlie said second layer in contiguous relationship therewith, the exterior distal surface of said first layer and the contiguously adjacent surface of said second layer each including said first and second slits formed therein.

3. Apparatus according to claim 2 wherein:

said first and second slits are formed in the manner of first and second grooves, said first and second layers including third and fourth grooves formed to oppose said first and second grooves in the respectively opposing surfaces of said first and second layers, said first and second grooves being separated from said third and fourth grooves by webs of predetermined thickness.

4. Apparatus according to claim 3 further comprising:

first and second strips respectively on the contiguously adjacent surfaces of said first and second layers in opposing alignment the adjacent surfaces of said first and second strips being bounded to each other.

5. A method for controlling the surface strain deformations of a resilient pad adapted to support the torso of a person comprising the steps of:

forming a first set of substantially parallel longitudinal preselected depth of said pad for limiting the joining thickness therebetween to a preselected modulus of strain.

6. Method according to claim 5 comprising the further steps of:

dividing said pad into two contiguously disposed layers of a common planform; and forming third and fourth slits in the contiguously disposed surface of said second layer substantially aligned with the respective ones of said first and second slits.

7. Method according to claim 6 wherein the steps of forming said first, second, third and fourth slits are limited to provide an integral peripheral section in said first and second layers.

* * * * *